United States Patent [19]

Numbers

[11] 4,094,433

[45] June 13, 1978

[54] DRINKING RECEPTACLE VALVE MEANS

[75] Inventor: Jody L. Numbers, Scottsdale, Ariz.

[73] Assignee: Thermo-Seal, Inc., Los Angeles, Calif.

[21] Appl. No.: 759,142

[22] Filed: Jan. 14, 1977

[51] Int. Cl.[2] ..... A47G 19/22

[52] U.S. Cl. ..... 220/90.4; 222/511; 222/518; 222/542

[58] Field of Search ..... 220/90.4; 222/508, 509, 222/511, 515, 518, 542; 251/77, 82, 83; 277/30, 83, DIG. 4

[56] References Cited

U.S. PATENT DOCUMENTS

| | | | |
|---|---|---|---|
| 3,964,631 | 6/1976 | Albert | 220/90.4 |
| 3,967,748 | 7/1976 | Albert | 220/90.4 |
| 3,972,443 | 8/1976 | Albert | 220/90.4 |

*Primary Examiner*—William Price
*Assistant Examiner*—Allan N. Shoap
*Attorney, Agent, or Firm*—William H. Dean; Don J. Flickinger; John A. Robertson

[57] ABSTRACT

The disclosure relates to an enclosed cup like drinking receptacle having a cover provided with a drinking opening therein which is disposed near the peripheral portion of the cover; the drinking opening being controlled by a liquid dispensing valve and a pneumatic pressure relief valve, both carried by a common manual actuator such that both valves are moved in unison and the dispensing valve being moveable relative to its seat a short distance without breaking its seal relative to said seat and to provide for sufficient movement of the pressure relief or vent valve to vent pneumatic pressure from the interior of said receptacle and cover so as to prevent unwarrented flow of hot beverages or the like through said dispensing valve and said drinking opening and thereby allowing a person to drink through said drinking opening with the normal flow of a hot beverage or other beverage therethrough.

2 Claims, 7 Drawing Figures

DRINKING RECEPTACLE VALVE MEANS

BACKGROUND OF THE INVENTION

Enclosed cup like drinking receptacles have heretofore been provided with covers and liquid dispensing valves as well as pneumatic pressure relief valves or vent valves. However, these mechanisms have been relatively complex involving a multiplicity or parts and also involving production costs attendant to the use of labor assembling the parts after they have been produced.

Accordingly, some prior art drinking receptacles with the aformentioned valves are relatively complicated and expensive.

SUMMARY OF THE INVENTION

The invention comprises an enclosed cup like drinking receptacle having a cover in which a drinking opening is disposed adjacent the periphery of the cover and wherein a liquid dispensing valve controls the flow of liquid through the drinking opening and a pneumatic pressure relief valve also is disposed internally of the cover to automatically release pneumatic pressure before the dispensing valve, controlling flow through the drinking opening, is disengaged from its seat whereby pneumatic pressure internally of the drinking receptacle may be relieved automatically before a person drinks from the drinking opening. This function is accomplished by an actuator which carries both the drink dispensing valve and the pneumatic pressure relief or vent valve and both valves are operated in unison by a common manual operation; the dispensing valve having means to maintain an intimate contact with a valve seat around the aforementioned drinking opening while also being moved a short distance during which time the common actuator carries the pneumatic pressure relief or vent valve to an open position to vent pneumatic pressure from the interior of the drinking receptacle before hot or other beverages are permitted to flow through the aforementioned drinking opening. The simplicity of the invention is provided by a common one piece actuator which carries both the disposing valve and the vent or pressure relief valve such that both valves are operated in unison and the dispensing valve is capable of being moved a short distance without breaking its seal relative to its valve seat, during which time of movement the pressure or relief valve is open. Accordingly, the dispensing valve is capable of being moved a short distance without allowing a liquid beverage to flow through the drinking opening in the cover of the invention and a variety of features of the valve may be provided such as a sliding valve feature or a valve having a resilient deflectable seal means which allows sufficient movement of the valve actuator to open the vent or relief valve before the dispensing valve is opened relative to the drinking opening and before a person may drink hot coffee or the like through the drinking opening in the cover of the receptacle.

The simple structure of the invention comprises a valve actuator carrying both of the aforementioned valves, namely the dispensing valve and the vent or pressure relief valve, and a single spring acts to hold the dispensing valve closed and also to hold the vent valve or pressure relief valve closed and the common actuator operates both valves in unison.

Accordingly, it is an object of the invention to provide an enclosed cup like drining receptacle having a cover and liquid dispensing valve means and pressure relief valve means which are extremely simple and economical to produce and assemble.

Another object of the invention is to provide an enclosed cup like drinking receptacle having a cover with a drinking opening therein, there being a liquid dispensing valve controlling the flow through the drinking opening and a vent valve inside the cover to vent pneumatic pressure therein, the simple construction of the valve means comprising a common actuator adapted to operate both valves in unison such that the vent valve is opened first and the pneumatic pressure relief valve is concurrently moved a short distance during which it maintains its seal with the seat on the understide of the cover so as to permit pneumatic pressure to be vented to outside atmosphere before liquid is allowed to flow through said drinking opening by said dispensing valve.

Another object of the invention is to provide an enclosed cup like drinking receptacle having a liquid dispensing valve and a vent valve operable in unison by a single actuator and having a single spring tending to hold both valves closed.

Further objects and advantages of the invention may be apparent from the following specification, appended claims and accompanying drawings.

DESCRIPTION OF THE PREFERRED EMBODIMENTS

Figure 1:
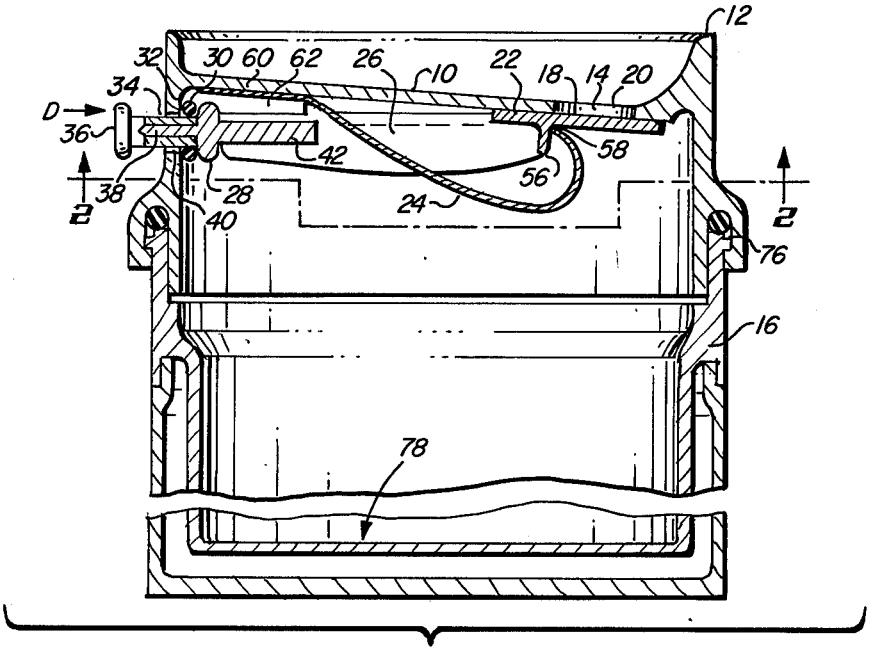
FIG. 1 is a sectional view of an enclosed cup like drinking receptacle of the invention showing portions thereof broken away and fragmentarily and showing drink dispensing valve means and pneumatic pressure relief or vent valve means in operable position in the cover of said receptacle.
Figure 2:
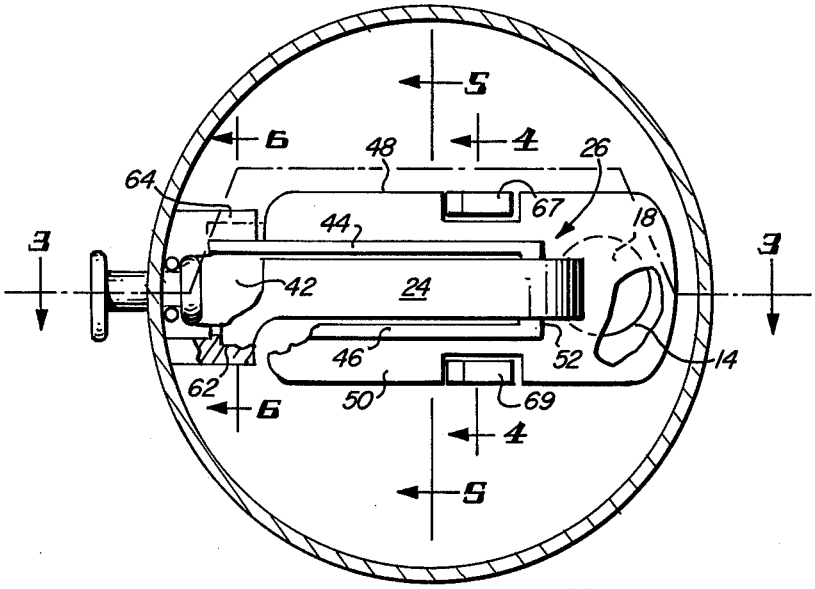
FIG. 2 is a sectional view taken from the like 2—2 of FIG. 1.
Figure 3:
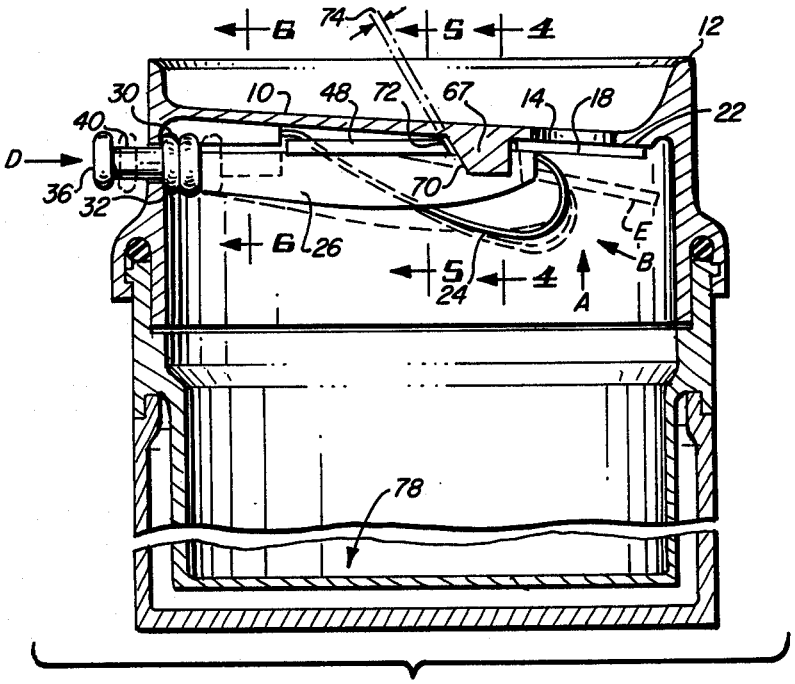
FIG. 3 is a sectional view similar to FIG. 1 but taken from the line 3—3 of FIG. 2.
Figure 4:
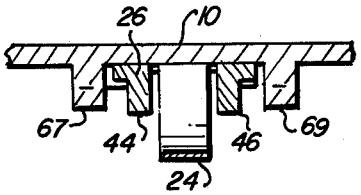
FIG. 4 is a fragmentary sectional view taken from the lines 4—4 of FIGS. 2 and 3.

As shown in FIGS. 1, 2 and 3, the enclosed drinking receptacle of the invention is provided with a cover 10 having a peripheral portion 12 adjacent to which a drinking opening 14 is disposed; this opening 14 normally communicating with the interior of a receptacle 16 on which the cap 10 is removeably sealed. The drinking opening 14 is capable of dispensing liquid from the interior of the receptacle 16 when a dispensing valve 18 is opened, as will be hereinafter described.

The dispensing valve 18, as shown in FIG. 1 of the drawings, is provided with a flat surface 20 which intimately engages a flat surface 22 of the cover 10 surrounding the opening 14 which is the drink dispensing opening adjacent to the periphery 12 of the cover 10 and through which a person may drink beverages or the like when the valve 18 is opened.

The valve 18, at its smooth flat surface 20, thus seals against the corresponding flat surface 22 and pressure inside the receptacle 16 such as pneumatic pressure tends to hold the valve 18 closed while the valve 18 is normally held closed by means of a spring 24 as will be hereinafter described.

The valve 18 is carried by a valve actuator 26 which is a single piece member with which the valve 18 is integral. The valve actuator 26 is provided with an O-ring mounting flange 28 adjacent to which an O-ring 30 is carried on the actuator 26. This O-ring 30 is normaly seated against an inner side 32 of the cover 10 and thereby forms a pressure relief on vent valve adapted to vent pneumatic pressure from the interior of a receptacle 16. The O-ring 30 surrounds the shank 34 of a manually operable knob 36; the shank 34 being hollow and positioned over an extending stub 38 integral with the actuator 26 and the hollow structure 34 of the manually operable knob is of smaller diameter than a vent opening 40 in the cover through which the structure 34 extends so that when the retaining flange 28 of the actuator 26 is moved away from the inner wall 32, the O-ring 30 is carried thereon and displaced from its position around the vent opening 40 such that pneumatic fluid is vented through the opening 40 which is larger than the hollow structure 34 of the manual knob 36.

The actuator 26 adjacent to the O-ring retainer portion 28 is provided with a bar portion 42 which is integral therewith. This bar portion 42 is also integral with a pair of spaced apart rail members 44 and 46 which have outwardly extending respective flanges 48 and 50 which operate in adjacent relationship to the inner surface of the cover 10.

The valve member 18 constitutes a flat portion of the actuator 26 and this actuator 26 at the ends of the structures 44 and 46 is provided with a cross member portion 52 which is integral therewith. This cross member portion 52 is engaged by an end 58 of the spring 24; the opposite end 60 of which is held captive in opposed channels 62 and 64 which are integral with the cover 10.

Figure 6:
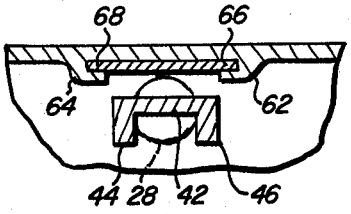
FIG. 6 is a fragmentary sectional view taken from the lines 6—6 of FIGS. 2 and 3.

With reference to FIG. 6 of the drawings, it will be seen that the channels 62 and 64 hold opposite edge portions 66 and 68 of the spring 24 captive.

Figure 5:
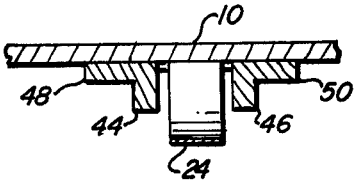
FIG. 5 is a fragmentary sectional view taken from the lines 5—5 of FIGS. 2 and 3.

The spring 24 is a flat plate spring of a general configuration shown in FIGS. 1 and 3 of the drawings and it extends between the portions 44 and 46 of the actuator member 26, all as shown best in FIGS. 1, 2 and 5 of the drawings.

A pair of cam structures 67 and 69 are integral with the cover 10. As shown in FIG. 3 of the drawings, the shape of the cam 67 is such as to provide an inclined surface 70 adjacent to which a cam engaging portion 72 of the flange portion 48 of the actuator is engageable. It will be seen that spacing, as indicated at 74 by lines and arrows, illustrates the spacing of the inclined surface 70 of the cam structure 67 and the respective inclined surface of the cam portion 72 of the flange 48.

The cam structures 69 and its related flange portion 50 shown in FIG. 2 are similar in that they employ related cam portions which are spaced substantially as shown at 74 in FIG. 3 of the drawings.

The spring 24 exerts force in the direction of an arrow A tending to hold the valve 18 against its seat 22 and the spring 24 also exerts force in the direction of an arrow B tending to hold the O-ring 30 of the vent or pressure relief valve intimately engaged with the inner surface 32 of the cover which surrounds the vent opening 40 as hereinbefore described.

As shown in FIG. 1 of the drawings, the cover 10 is provided with a bayonet lock and seal mechanism 76 which sealingly provides for removal of the cover 10 as may be desired from the receptacle 16 which is a cup like receptacle shown fragmentarily and which is a double wall structure providing for insulation; the receptacle having a bottom portion 78, a fragmentary portion of which is also shown in FIG. 3 of the drawings.

In operation, the cup like receptacle is filled with liquid, such as hot coffee or any other beverage, and the thermal insulation character of the cup tends to hold the heat in the coffee and the valve 18 and the vent valve, including the O-ring 30, prevents spillage or escape of the beverage or heat therefrom while both the vent valve and the dispensing valve are closed.

When a person is desired of taking a drink of hot coffee from the peripheral edge 12 of the cover 10, he places his lips over the edge 12 so as to receive liquid from the drinking opening 14 and he then presses the manual actuating knob 36 in the direction of an arrow D in FIGS. 1 and 3 of the drawings. Manual pressure on the knob 36 deflects the spring 24 and slides the valve member 18 along the seat 22 for a short distance while maintaining sealed contact and during this short distance the O-ring 30 is opened relative to the opening 40 and pneumatic fluid pressure is vented through the opening 40. The short distance of movement of the actuator 26 by the manually engageable knob 36 opens the O-ring 30 relative to the opening 40 before the cam portions 72 move the distance 74, which is a short distance shown in FIG. 3 of the drawings, such as to engage the cam portions 72 with the slope portions 70 of the cams 67 and 69. Thus, the short distance represented by the lines 74 in FIG. 3 of the drawings represent a distance which allows the vent valve of the invention to be opened and to vent pneumatic fluid pressure from the interior of the receptacle to the outside atmosphere while still maintaining sliding contact of the valve 18 with its seat 22. Thus, pneumatic fluid is vented before it is possible for any hot liquid to pass through the drinking opening 14 and to the mouth of the person whose lips are over the peripheral edge 12 of the cover 10.

Further movement of the manual actuator knob 36 in the direction of the arrow D causes the cam portions 72 to slide on the inclined cam surfaces 70 and to move the valve 18 into the broken line position E, as shown in FIG. 3, exposing the opening 14 to the flow of coffee or any other beverage to the mouth of the person whose lips are over the peripheral edge 12 of the cover 10. It will be seen that the actuator 26 moves both the liquid dispensing valve or drinking valve 18 and the vent valve 30 in unison and that the dispensing valve 18 moves a short distance without breaking its seal relative to the seat 22 allowing the vent valve 30 to open and vent pneumatic pressure before any liquid is allowed to pass through the drinking opening 14.

Figure 7:
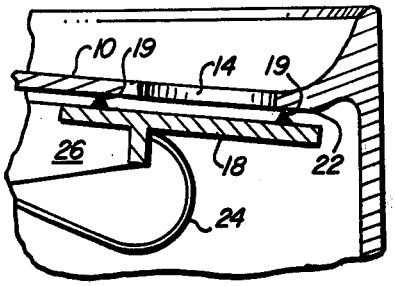
FIG. 7 is a fragmentary sectional view taken on the same plane as that shown in FIG. 3 but showing a modification of the liquid dispensing valve of the invention.

In the modification, as shown in FIG. 7, the cover 10 and drinking opening 14 are identical to that shown in FIG. 3; the actuator 26 is similar and the vent 30 is similar and the spring 24 is similar to that shown in FIG. 3. The valve 18 in the modification, in the modification shown in FIG. 7, is provided with a soft resilient seal element or lip 19 which surrounds the opening 14 and engages the seat 22. This seal lip 19 may be slightly deflected and thus, allows it to maintain a seal during the short movement 74 as shown in FIG. 3 of the drawings while both the vent valve and the liquid dispensing valve are operated in unison.

It will be obvious to those skilled in the art that various modifications of the invention may be resorted to without departing from the spirit thereof.

I claim:

1. In a drinking vessel of heat-insulating material:

(a) a receptacle;

(b) a cover for said receptacle, said cover including a top wall formed with a dispensing opening and a cylindrical wall depending from said top wall and formed with a pneumatic vent;

(c) a valve for said dispensing opening in the form of a flat plate in sealing engagement with a valve seat on the underside of said cover about said dispensing opening;

(d) a valve actuator integral with said dispensing valve and having a portion extending through said vent;

(e) a retainer flange on said actuator spaced from the inner surface of said cylindrical wall;

(f) an O-ring seal between said retainer flange and said inner surface of the cylindrical wall;

(g) an operating knob having a shank of lesser cross-sectional area than said vent through which it passes and is secured to the portion of said valve actuator which extends through said vent;

(h) a bar portion integral with said valve actuator and adjacent to said O-ring retainer flange;

(i) a pair of spaced-apart rail members each having an end integral with said bar portion and extending therefrom on opposite sides of said valve actuator;

(j) an outwardly extending flange on each of said rail members;

(k) a cross member integral with the other ends of said rail members;

(l) a leaf spring having an end portion secured to the underface of said cover and an intermediate bowed portion depending from the cover with the other end of the spring being secured to said dispensing valve, whereby said spring biases the dispensing valve into sealing position on said valve seat and the O-ring into sealing position relative to said vent; and (m) a pair of cams depending from said cover on opposite sides of said valve actuator and passing through recesses in the flanges on said rail members, each of said cams having a cam surface that is normally spaced from that portion of a flange on one of said rail membes which it confronts but which is engaged by said flange on said rail member after the valve actuator has been moved inwardly from the cylindrical wall of said cover a distance sufficient to open said pneumatic vent whereupon the engagement of said rail member flanges with said cam surfaces causes the valve actuator to move the valve for said dispensing opening into a position in which said dispensing opening is open.

2. The dispensing vessel of claim 1 together with a soft resilient seal element on said dispensing valve which is normally in engagement with said valve seat.

* * * * *